US006184787B1

(12) United States Patent
Morris

(10) Patent No.: US 6,184,787 B1
(45) Date of Patent: Feb. 6, 2001

(54) OVERHEAD GARAGE DOOR POSITION MONITORING SYSTEM

(76) Inventor: Duane A. Morris, 13990 Summit Ave., Garfield Heights, OH (US) 44137

( * ) Notice: Under 35 U.S.C. 154(b), the term of this patent shall be extended for 0 days.

(21) Appl. No.: 09/090,780

(22) Filed: Jun. 4, 1998

(51) Int. Cl.[7] ..... G08B 19/00

(52) U.S. Cl. ..... 340/521; 340/517; 340/533; 340/539; 340/584; 340/600; 340/628; 340/632; 340/686.1; 340/687; 340/692

(58) Field of Search ..... 340/521, 517, 340/531, 533, 539, 686.1, 687, 691.6, 584, 600, 628, 632, 692; 455/420; 307/116; 49/31

(56) References Cited

U.S. PATENT DOCUMENTS 4,107,484 * 8/1978 Pertereson, III ..... 200/43.04
4,338,526 * 7/1982 Martin et al. ..... 307/116
4,547,778 * 10/1985 Hinkle et al. ..... 342/456
4,559,526 * 12/1985 Tani et al. ..... 340/539
4,608,565 * 8/1986 Sakamoto ..... 340/870.17
4,665,378 * 5/1987 Heckethorn ..... 340/932.2
4,754,266 * 6/1988 Shand et al. ..... 340/691.2
4,808,995 * 2/1989 Clark et al. ..... 340/825.69
4,888,578 * 12/1989 Conemac ..... 340/546
5,006,832 * 4/1991 Beaudry ..... 340/574
5,008,648 * 4/1991 Conemac ..... 340/546
5,367,293 * 11/1994 Howard et al. ..... 340/687
5,802,467 * 9/1998 Salazer et al. ..... 455/420
5,986,540 * 11/1999 Nakagaki et al. ..... 340/384.7

* cited by examiner

*Primary Examiner*—Benjamin C. Lee
(74) *Attorney, Agent, or Firm*—Oldham & Oldham Co., L.P.A.

(57) ABSTRACT

Overhead garage door position monitoring systems including one or more smoke detector sensors, carbon monoxide sensors, thermal sensors and/or magnetic sensors to measure the smoke concentration level, the carbon monoxide level, the temperature and the position of an overhead garage door, respectively. These sensors are controlled by and report the status of parameters to a controller, such as a microcontroller. This controller is programmed to report the status of parameters through, for example, a liquid crystal display (LCD) and/or a voice synthesizer and an audio speaker.

20 Claims, 2 Drawing Sheets

OVERHEAD GARAGE DOOR POSITION MONITORING SYSTEM

BACKGROUND AND SUMMARY OF THE INVENTION

The present invention relates generally to new and novel improvements in overhead garage door position monitoring systems. More particularly, the present invention relates to overhead garage door position monitoring systems which are capable of monitoring parameters such as the carbon monoxide level, the temperature and the overhead garage door position and reporting out the status of these parameters using a voice synthesizer and speaker.

Attached garages are becoming increasingly popular across the United States to shelter motor vehicles from inclement weather and allow access to the motor vehicles without exposure to the elements. However, attached garages can present hazards. For example, the operating temperature of a motor vehicle is relatively high and includes electrical wiring and thus, a fire hazard may exist. In addition, if a motor vehicle is left running in an enclosed attached garage, dangerous levels of carbon monoxide can be present. Furthermore, it is often difficult to determine the position of the overhead garage door and, if left open, for example, overnight or during a work day, animals and/or unauthorized individuals can have access into the garage and perhaps even the dwelling through the garage.

Accordingly, an object of the present invention is the provision of overhead garage door position monitoring systems which can sense parameters such as the level of carbon monoxide, the temperature and the position of the overhead garage door and report out the status of such parameters through, for example, a voice synthesizer and a speaker output.

This and other objects of the present invention are attained by the provision of an overhead garage door position monitoring system including a carbon monoxide monitor, a thermal sensor and a magnetic sensor to measure the carbon monoxide level, the temperature and the position of an overhead garage door, respectively. These sensors are controlled by and report the status of parameters to a controller, such as a microcontroller. This controller is programmed to report the status of parameters through, for example, a visible message display, such as a low power liquid crystal display (LCD), and/or a voice synthesizer and audio speaker.

DETAILED DESCRIPTION OF THE DRAWINGS

Figure 1:
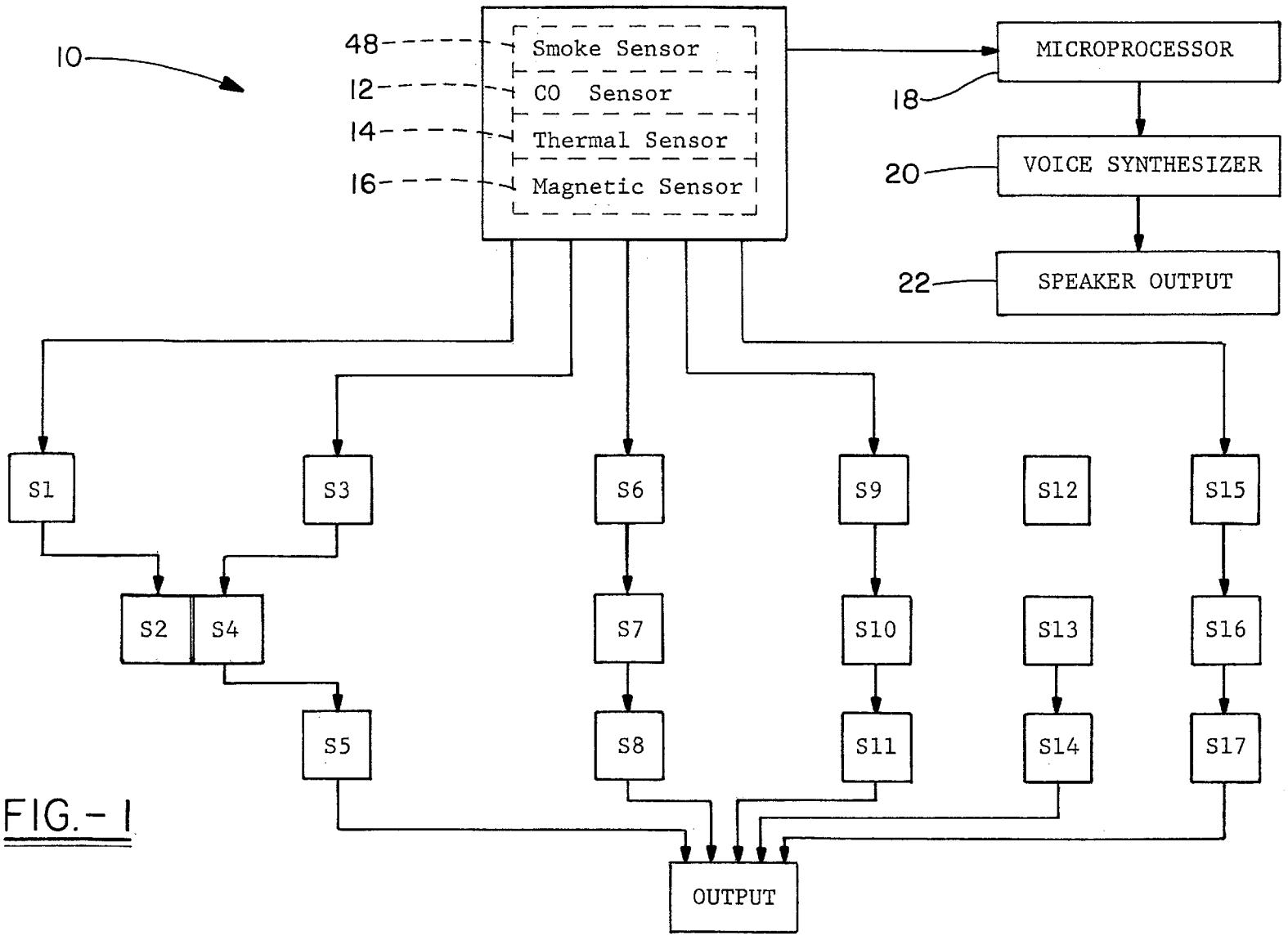
FIG. 1 is a flowchart of the parameters monitored and processes performed by a overhead garage door position monitoring system in accordance with a first preferred embodiment of the present invention.

In the following detailed description of preferred embodiments of the present invention, reference is made to the accompanying drawings which, in conjunction with this detailed description, illustrate and describe a first and a second preferred embodiment of an overhead garage door position monitoring system. Referring now to the drawings, in which like-identified characters represent corresponding elements throughout the several views, attention is first directed to FIGS. 1 and 2, which illustrate a flowchart of the parameters monitored and processes performed by a overhead garage door position monitoring system in accordance with a first preferred embodiment of the present invention, generally identified by reference number 10 and affront view, a back view and an inside view, respectively, of controller 18 used in overhead garage door position monitoring system 10 in accordance with the preferred embodiment of the present invention shown in FIG. 1. Overhead garage door position monitoring system 10 includes carbon monoxide sensor 12, thermal sensor 14 and magnetic sensor 16. Carbon monoxide sensor 12 measures the carbon monoxide level in, for example, an enclosed garage, which may become elevated due to, for example, a motor vehicle left running in the enclosed garage. Thermal sensor 14 measures the temperature, or alternatively, can be a smoke detector sensor, to determine if a fire is present in, for example, an enclosed garage, which has started from, for example, a motor vehicle engine or electrical wiring or from flammable materials stored in the enclosed garage. In a particularly preferred embodiment of overhead garage door position monitoring system 10, thermal sensor 14 is positioned outside of the garage to measure outside temperature and smoke detector sensor 48 is positioned inside the garage to determine if a fire is present in, for example, the enclosed garage. Magnetic sensor 16 is positioned to monitor the position of one or more conventional overhead garage doors. Carbon monoxide sensor 12, thermal sensor 14, magnetic sensor 16 and smoke detector sensor 48 are all controlled by and report the parameters measured to controller 18, preferably a microcontroller. Controller 18 provides instructions to voice synthesizer 20 which, in turn, transmits audio signals through audio speaker 22.

Turning now to the operation of overhead garage door position monitoring system 10, when conventional overhead garage door is closed (S1), magnetic sensor 16 is closed, and no messages are sent from magnetic sensor 16 to controller 18 (S2). On the other hand, when conventional overhead garage door is open by more than a specified distance (S3), magnetic sensor 16 is opened, and a continuous signal is sent from magnetic sensor 16 to controller 18. Controller 18, upon receipt of the continuous signal from magnetic sensor 16, forwards appropriate instructions to voice synthesizer 20 (S4) to provide an audible warning at preselected intervals of time. For example, voice synthesizer 20 can initiate an audible warning such as "Garage door is ajar for 'x' amount of time and the outside temperature is 'x°'" which is output through audio speaker 22 (S5). If smoke detector sensor 48 senses less than a predetermined concentration of smoke, or alternately if the temperature measured inside the garage is less than a predetermined temperature, for example, 110° F., no signal is sent from smoke detector sensor 48 to controller 18. However, if a greater than a predetermined concentration of smoke is detected by smoke detector sensor 48 (S15), or alternatively if the temperature measured inside the garage is more than a predetermined temperature, for example 110° F., a signal is sent by smoke detector sensor 48 to controller 18 (S16). Upon receipt of a signal from smoke detector sensor 48, controller 18 sends an immediate instruction to voice synthesizer 20 which, in turn, provides a signal to audio speaker 22 to announce a repeated audible warning, such as "Smoke Detected—Check Carefully" (S17). If magnetic sensor 16 is positioned where the conventional garage door is completely open, magnetic sensor 16 will be triggered upon downward movement of the conventional overhead garage door and magnetic sensor 16 will send a signal to controller 18 (S6). Upon receipt of a signal from magnetic sensor 16 that the conventional overhead garage door is closing, controller 18 sends instructions to voice synthesizer 20 (S7) which, in turn, initiates a signal to audio speaker 22 to announce an audible warning, such as "Garage door is closing, please stand clear" (S8).

Similarly, if carbon monoxide sensor 12 senses less than a predetermined concentration of carbon monoxide, no signal is sent from carbon monoxide sensor 12 to controller 18. However, if a greater than a predetermined concentration of carbon monoxide is detected by carbon monoxide sensor 12, a signal is sent by carbon monoxide sensor 12 to controller 18 (S9). Upon receipt of a signal from carbon monoxide sensor 12, controller 18 sends an immediate instruction to voice synthesizer 20 (S10) which, in turn, provides a signal to audio speaker 22 to announce an audible warning such as "A high level of carbon monoxide has been detected" (S11).

Another feature of overhead garage door position monitoring system 10 allows a user to record a short message on controller 18 which can be played at some later time by, for example, another family member. This is done by pushing a button on controller 18 and speaking into a microphone to leave a short message which is stored in controller 18 (S12). Later, when an individual presses a play button, the short message is sent from controller 18 to voice synthesizer 20 (S13) and voice synthesizer 20 plays back the message last recorded through audio speaker 22 (S14).

Figure 2:
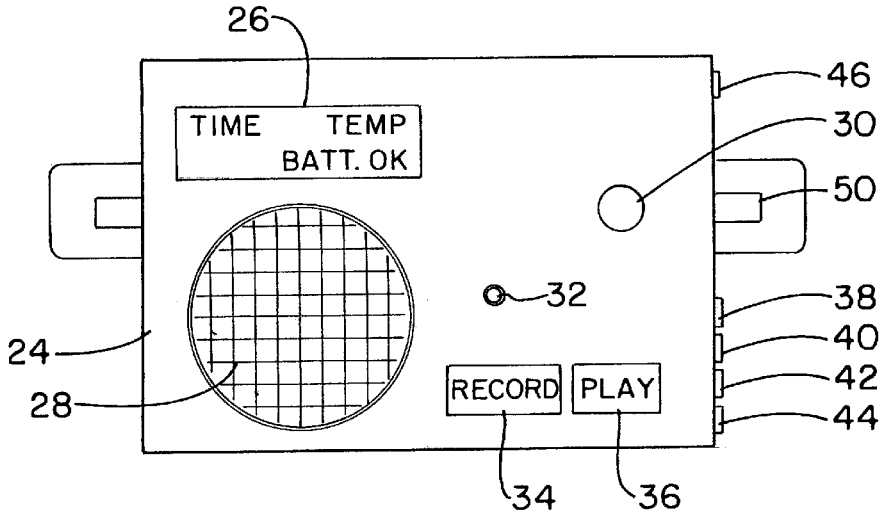
FIG. 2 is a front view, a back view and an inside view, respectively, of a controller for the overhead garage door position monitoring system in accordance with the first preferred embodiment of the present invention shown in FIG. 1.

Referring now to FIG. 2, which shows a front view, of controller 18 for overhead garage door position monitoring system 10 in accordance with a first preferred embodiment of the present invention shown in FIG. 1, controller 18 preferably includes controller housing 24, which can be fabricated from a plastic or metallic material. An opening in controller housing 24 permits viewing of message display 26, which is preferably a low power liquid crystal display (LCD) type display. Various types of information can be displayed on message display 26 such as, for example, the date, time, temperature, battery condition, overhead garage door position, carbon monoxide level or other desired information. If desired, controller 18 can include an on/off switch, which would preferably be operated by, for example, the tip of a pen so the on/off switch is not readily accessible to children and other unauthorized individuals. In addition, controller housing 24 includes speaker 28, volume control 30 and microphone 32. As discussed above, message record button 34 and message play button 36 are also preferably included on controller housing 24. Controller housing 24 also includes carbon monoxide sensor input port 38 for receiving signals from carbon monoxide sensor 12, one or more thermal sensor input ports 40 for receiving signals from one or more thermal sensors 14, one or more smoke detector sensor input ports 50 for receiving signals from one or more smoke detector sensors 48 and one or more magnetic sensor input ports 42 and 44 for receiving signals from one or more magnetic sensors 16. In addition, output port 46 is provided to transmit instructions to voice synthesizer 20, which, in turn, provides audible signals to audio speaker 22. Controller 18 preferably receives power from a battery source, most preferably a conventional 9-volt dry cell battery, but could also be, if desired, hard-wired into household electrical current with the option of using a battery source as a back-up power supply.

Figure 3:
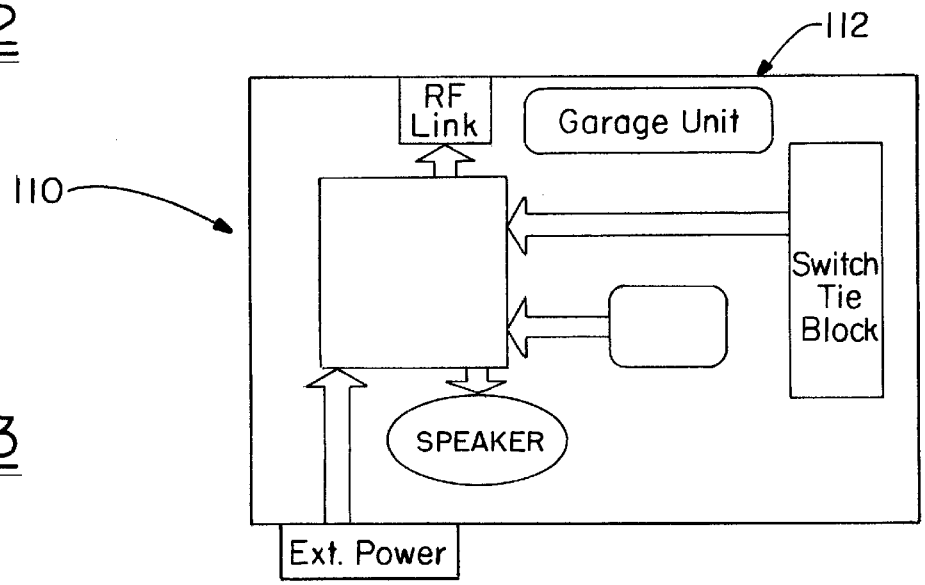
FIG. 3 is a block diagram of a house unit used in an overhead garage door position monitoring system in accordance with a second preferred embodiment of the present invention.
Figure 4:
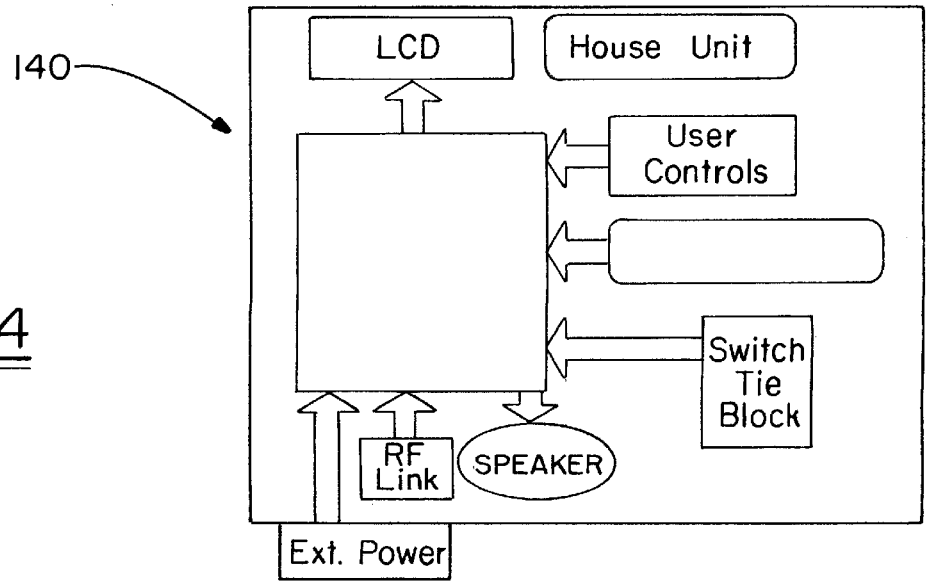
FIG. 4 is a block diagram of a garage unit used in the overhead garage door position monitoring system in accordance with the second preferred embodiment of the present invention.

Referring now to FIGS. 3 and 4, which illustrate a block diagram of garage unit 112 and a front schematic view of house unit 140, respectively, used in an overhead garage door position monitoring system in accordance with a second preferred embodiment of the present invention, generally identified by reference number 110. Overhead garage door position monitoring system 110 is a two (2) part device which monitors sensors in, for example, an attached garage, and provides selected information to users located nearby, such as in an attached or nearby house. Garage unit 112 is preferably mounted on a wall in the structure to be monitored, such as an attached garage, and includes sensors which detect the state of on/off switches and the ambient temperature in the structure. This information is formatted by garage unit 112 for transmission to house unit 140 which is mounted on the wall in, for example, an attached or nearby home. House unit 140 uses the information transmitted from garage unit 112 to activate indicators or play pre-recorded messages to users in the attached or nearby home. In addition, house unit 140 monitors the state of two (2) additional on/off switches for use with a carbon monoxide sensor and a fire sensor. Garage unit 112 is preferably housed in a wall mounted enclosure approximately six (6) inches by four (4) inches which is fabricated from a plastic or metallic material and is capable of surviving in a garage environment. House unit 140 is preferably housed in an enclosure approximately six (6) inches by four (4) inches which is fabricated from a plastic or metallic material and is preferably powered by dry cell batteries, such as four (4) 1.2 volt direct current "AA" or "C" size dry cell batteries, or, alternatively, can be hard-wired to a Underwriters Laboratories (UL) approved low voltage power source, such as household electrical current, with or without a battery backup power supply. A low battery power message is preferably provided in the low power liquid crystal display (LCD) to provide a message to replace the dry cell batteries when the power provided by the dry cell batteries is insufficient to operate house unit 140. A radio frequency (RF) link is preferably provided to facilitate the transmission of information from garage unit 112 to house unit 140.

Referring now to FIG. 3, garage unit 112 is preferably powered by a Underwriters Laboratory (UL) approved external power source, such as household electrical current, although battery power could alternatively be used, and includes one tie block which allows users to connect up to six external switches thereto using only a screw driver and without opening the garage unit 112 enclosure.

Referring now to FIG. 4, house unit 140 generally includes two (2) large buttons which are used to record and play back user recorded audio messages. Three (3) additional buttons are provided to select programmable functions such as displaying the temperature in degrees Fahrenheit (° F.) or degrees Celsius (° C.), setting the time and setting the overhead garage door open time interval. A volume control is also provided to permit adjustment of the volume of played messages. In addition, house unit 140 preferably includes low power liquid crystal display (LCD), such as a two (2) line by sixteen (16) character low power liquid crystal display (LCD), and an audio speaker for pre-recorded and user generated audio messages. Connections are also provided for two (2) external on/off type switches for monitoring an external carbon monoxide sensor and a fire sensor.

Garage unit 112 preferably transmits the state of the switches and temperature to house unit 140 via a radio frequency (RF) link which can be detected by house unit 140 up to a distance of approximately one hundred (100) feet. Thus, house unit 140 includes a radio frequency (RF) receiver for receiving signals from garage unit 112. Through this radio frequency (RF) link, house unit 140 can determine the state of the switches and the temperature measured by garage unit 112. Garage unit 112 also preferably includes an external remote temperature sensor with a cable allowing sensing of the temperature in a range of, for example, −10° F. to 150° F., up to ten (10) feet away from garage unit 112 to allow, for example, the outside temperature to be monitored by garage unit 112.

House unit 140 will preferably normally display the time and the high, low and current temperature sensed by garage unit 112. When any of the switches in garage unit 112 are activated, house unit 140 will display an appropriate message for that switch on low power liquid crystal display (LCD) for that particular switch. Also, when one of the switches in garage unit 112 is activated for a preprogrammed time, house unit 140 will play a pre-recorded audio message through the audio speaker for the appropriate switch. Thus, garage unit 112 monitors the state of the switches and sends updated information to house unit 140 via a radio frequency (RF) link. Garage unit 112 also plays pre-recorded messages when the conventional overhead garage door closes. All of the electrical circuitry for garage unit 112 and house unit 140 will be housed in their respective enclosures with the exception of the tie block in garage unit 112 for connecting external switches. Overhead garage door position monitoring system 110 is preferably capable of operating in temperature ranging from −10° C. to 70° C., in ambient humidity from 0% to 95% non-condensing and the electronics are capable of withstanding shock and vibration up to 2 g continuous or 3 g non-repetitive.

Although the present invention has been described above in detail, the same is by way of illustration and example only and is not to be taken as a limitation on the present invention. For example, other types of doors, windows and appliances could also be monitored using overhead garage door position monitoring systems 10 and 110 in accordance with the present invention. In addition, various other types of sensors, displays and/or alarms could be used in conjunction with overhead garage door position monitoring systems 10 and 110 in accordance with the present invention. Another possible method of reporting is via remote control, for example, through radio frequency (RF). In this embodiment, a transmitter sends radio frequency (RF) signals to a receiver which includes a speaker or through a frequency modulated (FM) receiver to transmit an audible voice message into any room in a building or dwelling up to a certain range, for example, 100 to 150 feet. The radio frequency (RF) transmission could also be conducted through existing alternating current (AC) wiring and electrical outlets. Accordingly, the scope and content of the present invention are to be defined only by the terms of the appended claims.

What is claimed is:

1. An overhead garage door position monitoring system, comprising a carbon monoxide sensor, a thermal sensor, a magnetic sensor to monitor the position of the overhead garage door and a controller for receiving input from said carbon monoxide sensor, said thermal sensor and said magnetic sensor to monitor the position of the overhead garage door and reporting out said input received, said controller includes a microphone and permits users to leave and retrieve prerecorded audio message on said controller.

2. The overhead garage door position monitoring system in accordance with claim 1, wherein said controller is hard-wired to household electrical current and receives power from said household electrical current.

3. The overhead garage door position monitoring system in accordance with claim 1, wherein said controller includes one or more dry cell batteries and receives power from said one or more dry cell batteries.

4. The overhead garage door position monitoring system in accordance with claim 1, wherein said controller includes an on/off switch which is operable by a tip of a pen so said on/off switch is not readily accessible to children and unauthorized individuals.

5. The overhead garage door position monitoring system in accordance with claim 1, wherein said input received is reported out by a low power liquid crystal display (LCD).

6. The overhead garage door position monitoring system in accordance with claim 1, wherein said input received is reported out by a voice synthesizer and audio speaker.

7. The overhead garage door position monitoring system in accordance with claim 1, wherein said thermal sensor is positioned outside to monitor and report the external temperature.

8. The overhead garage door position monitoring system in accordance with claim 1, wherein said controller is a microcontroller.

9. The overhead garage door position monitoring system in accordance with claim 1, wherein said controller reports out the information received to a house unit via a radio frequency (RF) link.

10. The overhead garage door position monitoring system in accordance with claim 1, wherein said controller is housed in a wall mountable enclosure fabricated from one of a plastic material and a metallic material.

11. An overhead garage door position monitoring system, comprising a garage unit including a carbon monoxide sensor, a thermal sensor, a magnetic sensor to monitor the position of the overhead garage door and a controller for receiving input from said carbon monoxide sensor, said thermal sensor and said magnetic sensor to monitor the position of the overhead garage door and reporting out said input received to a house unit, said house unit including a visible message display to report out selected information from said input received from said garage unit, a voice synthesizer which converts said input received from said garage unit into one or more spoken word audible warnings, an audio speaker to report out said one or more spoken word audible warnings received from said voice synthesizer and a microphone which permits users to leave and retrieve prerecorded audio messages on said house unit.

12. The overhead garage door position monitoring system in accordance with claim 11, wherein said garage unit reports out the information received to said house unit via a radio frequency (RF) link.

13. The overhead garage door position monitoring system in accordance with claim 11, wherein said garage unit is hard-wired to household electrical current and receives power from said household electrical current.

14. The overhead garage door position monitoring system in accordance with claim 11, wherein said house unit includes one or more dry cell batteries and receives power from said one or more dry cell batteries.

15. The overhead garage door position monitoring system in accordance with claim 11, wherein said visible message display in said house unit is a low power liquid crystal display (LCD).

16. The overhead garage door position monitoring system in accordance with claim 11, wherein said thermal sensor is positioned outside to monitor and report the external temperature.

17. The overhead garage door position monitoring system in accordance with claim 11, wherein said house unit includes a microcontroller.

18. The overhead garage door position monitoring system in accordance with claim 11, wherein said garage unit and said house unit are housed in wall mountable enclosures fabricated from one of a plastic material and a metallic material.

19. The overhead garage door position monitoring system in accordance with claim 11, wherein said garage unit includes an on/off switch which is operable by a tip of a pen so said on/off switch is not readily accessible to children and unauthorized individuals.

20. The overhead garage door position monitoring system in accordance with claim 11, wherein said prerecorded audio message are replayed through said audio speaker.

* * * * *